United States Patent [19]

Berriman

[11] 4,122,810

[45] Oct. 31, 1978

[54] AUTOMOTIVE EXHAUST GAS RECIRCULATION VALVE

[75] Inventor: Lester P. Berriman, Irvine, Calif.

[73] Assignee: Dresser Industries, Inc., Dallas, Tex.

[21] Appl. No.: 813,585

[22] Filed: Jul. 7, 1977

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,972,312 | 8/1976 | Walker | 123/119 A |
| 3,974,807 | 8/1976 | Nohira | 123/119 A |
| 3,978,834 | 9/1976 | Arnaud | 123/119 A |
| 3,981,283 | 9/1976 | Kaufman | 123/119 A |
| 4,056,083 | 11/1977 | Wakita | 123/119 A |
| 4,071,005 | 1/1978 | Nakajima et al. | 123/119 A |

*Primary Examiner*—Wendell E. Burns
*Attorney, Agent, or Firm*—Daniel Rubin

[57] ABSTRACT

An exhaust gas recirculation valve for installation in the recirculation flow path between the exhaust and intake manifolds of an internal combustion engine. A metering control in the form of an axially displaceable pintle is operative in the flow path of a throat body to form an annular convergent-divergent nozzle. Pintle movement is responsive to predetermined engine variables to vary the throat flow area for continuously maintaining sonic gas flow therethrough. By the pintle being disposed toward closing the throat in a direction counter to the direction of incoming gas flow, sonic flow can be maintained at high efficiency throughout the full range flow capacity required of the valve.

11 Claims, 5 Drawing Figures

AUTOMOTIVE EXHAUST GAS RECIRCULATION VALVE

BACKGROUND OF THE INVENTION

The field of art to which the invention pertains includes internal combustion engines including use of exhaust gas charge.

Long standard in aiding control of emitted oxides of nitrogen from American manufactured internal combustion engines for automobiles has been the use of exhaust gas recirculation (EGR) in which exhaust gases are reintroduced with fresh fuel to the intake manifold during the subsequent operating cycle. For controlling quantities of recirculated gas flow over the varying parameters of engine operation, it has been common to employ an exhaust gas recirculation valve of usually the poppet or butterfly type in the recirculation path to proportionately open and close the flow passage as required.

As a practical matter, little if any exhaust gas recirculation is desired either at idle or wide open throttle (WOT) and such valves have only been approximately accurate in controlling flow quantities under operating conditions intermediate therebetween. More advanced EGR systems attempt to provide EGR during engine operation when high oxides of nitrogen levels are being produced. When oxides of nitrogen production is minimal, they attempt to eliminate EGR since the addition of EGR under those operating modes only reduces engine economy. Controls therefor have generally been responsive to a combination of engine operating parameters which are all indirect indications of oxides of nitrogen production.

In recognition of the foregoing limitations of operational accuracy, U.S. Pat. No. 3,981,283 to Kaufman proposed the use of a sonic flow metering control utilizing an axially displaceable pintle in a convergent-divergent nozzle. The pintle moves axially toward and away from the nozzle throat in order to throttle flow more or less in accordance with engine requirements, and to close the throat moves in a direction directly coinciding with the direction of incoming flow. Since sonic velocity theroretically represents maximum flow rate that can occur through a given size orifice, the patentee perceived that under conditions of sonic operation reproducible control accuracy of valve operation would thereby be enhanced.

While theoretically accurate, it has been determined that a device such as disclosed by Kaufman is unable to maintain sonic velocity at high efficiency over the entire operating range contemplated for an EGR valve which usually processes on the order of between about 60 CFM to about 1 CFM or less. With sonic operation limited to less than the required entire operating range contemplated for the valve, the perceived sonic mode effectiveness of that device is similarly limited to intermediate values only of max./min. CFM termed "turn down ratio."

Moreover, most currently available EGR valves operate in a manner whereby if failure occurs they fail in a closed mode. Closure, however, essentially eliminates the use of EGR and produces high levels of oxides of nitrogen. Since the automobile will usually achieve greater economy and better driveability in this failed mode, the faulty EGR valve is unlikely to be repaired.

Despite recognition of the foregoing problems, a ready solution has not heretofore been known.

SUMMARY OF THE INVENTION

This invention relates to an exhaust gas recirculation valve for automotive internal combustion engines. More specifically, the invention relates to such a valve able to maintain sonic flow substantially if not completely over the entire turn down range contemplated for the internal combustion engine on which it is to be applied.

The foregoing is achieved in accordance herewith by utilizing an axially displaceable pintle cooperating in the flow path of a throat body to form an annular convergent-divergent nozzle. Displacement of the pintle is under control of one or more predetermined engine variables for varying the throat flow area to maintain sonic gas flow velocity therethrough. Like the Kaufman device supra, the pintle hereof is moved toward and away from the throat for closing and opening the flow area, respectively. Diametrically opposed to the Kaufman device, the pintle hereof moves toward closing in a direction counter to the direction of incoming gas flow for throttling the recirculating gas in accordance with engine requirements. By essentially inverting the pintle with respect to the direction of gas flow as compared to prior art operation, sonic operation has been significantly extending as to enable sonic velocity and the control factors incident thereto to be achieved at high efficiency throughout the entire contemplated range of the valve. Moreover, should failure occur it fails in the open position thereby continuing to afford some of the benefit of exhaust gas recirculation. By operating the valve under control of engine combustion temperature, direct control is obtained over production of oxides of nitrogen.

It is therefore an object of the invention to provide novel method and apparatus for exhaust gas recirculation of an internal combustion engine.

It is a further object of the invention to provide a novel exhaust gas recirculating valve sonically operable under increased turn down ratios as compared to similar purpose valves of the prior art.

It is a further object of the invention to provide a novel sonic exhaust gas recirculation valve requiring greatly reduced and more uniform operating force than comparable EGR valves of the prior art.

It is a further object of the invention to provide a novel sonic exhaust gas recirculating valve which is still somewhat controlling in the failure mode by failing in a direction which continues to afford the benefits of exhaust gas recirculation.

It is a further object of the invention to provide an exhaust gas recirculation valve controlled by combustion temperature able thereby to control oxides of nitrogen production by the engine.

It is a still further object of the invention to effect the foregoing objects with a relatively minor construction change not significantly adding if at all to the manufacturing cost of such valves.

Figure 1:
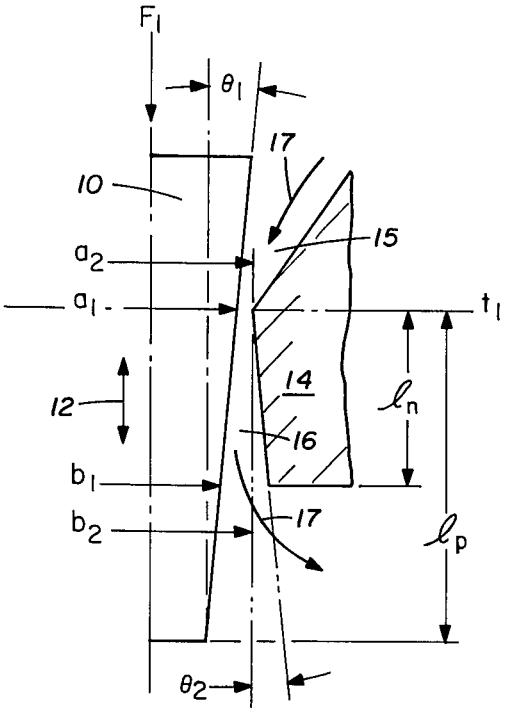
FIG. 1 PRIOR ART
FIG. 1 is a schematic representation of a prior art pintle axially displaceable toward closure directionally coincident with incoming flow.

Referring initially to FIG. 1, there is illustrated an annular tapered pintle 10 of a prior art type axially displaceable as per arrows 12 relative to a throat body 14 to form an annular converging-diverging nozzle therebetween. Pintle 10 cooperates with throat body 14 to form a throat plane $t_1$ above which is formed an intake 15 and below which is formed a diffuser 16. As disclosed, for example, in U.S. Pat. No. 3,778,038, diffuser 16 should diverge at a controlled rate of expansion to provide efficient energy recovery and for which the area ratio between the throat and exit planes as disclosed by U.S. Pat. No. 3,965,221 should preferably be in the range of about 1.3–20. Throat $t_1$ defines the location at which sonic flow occurs about pintle 10 as it moves toward and away therefrom in a throttling relation varying the flow area therebetween for incoming exhaust gas represented by arrows 17.

Figure 2:
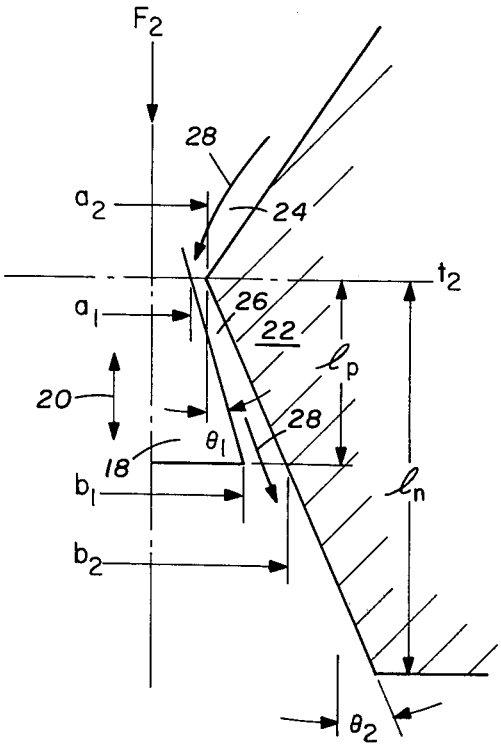
FIG. 2 is a schematic representation of the pintle hereof axially displaceable toward closure directionally counter to incoming flow.

FIG. 2 likewise utilizes an annular tapered pintle 18 axially displaceable as per arrows 20 relative to a throat body 22 to form an annular converging-diverging nozzle therebetween. Similarly as above, pintle 18 cooperates with the nozzle to form a throat plane $t_2$ above which is formed an intake 24 and below which is formed a diffuser 26 of gradually increasing cross section. Displacement of pintle 18 varys the flow area through throat $t_2$ for incoming exhaust gas represented by arrows 28.

A mathematical comparison of geometrical flow characteristics between the structures of FIGS. 1 and 2 will now be provided on the basis of the following nomenclature:

$a_1$ = inner radius at throat planes $t_1$, $t_2$
$a_2$ = outer radius at throat planes $t_1$, $t_2$
$l_p$ = diffuser exit plane
$l_n$ = nozzle exit plane
$b_1$ = inner radius at diffuser exit $l_p$
$b_2$ = outer radius at diffuser exit $l_p$
$A_t = \pi (a_2^2 - a_1^2)$ and = open flow area at throat planes $t_1$, $t_2$
$A_e = \pi (b_2^2 - b_1^2)$ = open flow area at diffuser exit plane $l_p$
Min. = minimum flow condition
Max. = maximum flow condition
$A_e/A_t$ = area ratio
$(A_t)$ Max./$(A_t)$ Min. = turn down ratio
$\theta_1$ = Pintle cone angle
$\theta_2$ = Diffuser cone angle From a geometry standpoint, the area ratio of the FIG. 1 unit at min. can be defined as:

$$\left(\frac{A_e}{A_t}\right)_{Min.} = \frac{(A_t)_{Max.}}{(A_t)_{min.}} \times \frac{(A_e)_{Min.}}{(A_t)_{Max.}}$$

and from which it can be derived that:

$$\left(\frac{A_e}{A_t}\right)_{Min.} > \frac{(A_t)_{Max.}}{(A_t)_{Min.}}\left\{\left(\frac{A_e}{A_t}\right)_{Max.} - 1\right\}$$

For an assumed turn down ratio of 60 and an $(A_e/A_t)$ max. of 2, $(A_e/A_t)$ min. is about 60 and for an $(A_e/A_t)$ max. of 1.5, $(A_e/A_t)$ min. is about 30. The latter represents an extreme situation that can only be practically approached by use of a pintle 10 of very small angle $\theta$, and hence very long travel between min. and max.

By comparison, $(a_1)$ max. of the FIG. 2 unit is zero and $$(b_2)_{max.} = a_2 + b_1\left(\frac{\tan\theta_2}{\tan\theta_1}\right)$$

Thus, $$\left(\frac{A_e}{A_t}\right)_{Max.} = \left(1 + \frac{b_1}{a_2}\,\frac{\tan\theta_2}{\tan\theta_1}\right)^2 - \left(\frac{b_1}{a_2}\right)^2$$

and for a turn down ratio of 60

$$\left(\frac{A_e}{A_t}\right)_{Min.} \simeq 60\left\{\left[1 + \left(\frac{b_1}{a_2} - 1\right)\frac{\tan\theta_2}{\tan\theta_1}\right]^2 - \left(\frac{b_1}{a_2}\right)^2\right\}$$

At the turn down ratio of 60 $(a_1)$ min. is approximately $0.99a_2$ such that by appropriate choices of $(b_1/a_2)$ as for example 1.5, and $(\tan\theta_2/\tan\theta_1)$, as for example about 1.05, the area ratios at min. and max. can be maintained in the efficient range of between about 4 and 5. This condition would be satisfied, for example, if $\theta_1 = 30°$ and $\theta_2 = 31.22°$.

On the basis of the foregoing, it can be seen that geometrically speaking the unit of FIG. 2 can provide efficient area ratios of between 1.3–20 for flows associated with large turn down ratios whereas the unit of FIG. 1 cannot.

On the basis of isentropic flow characteristics, a large area ratio at low flow would not appear to be detrimental. However, qualifying the above geometric evaluation are the real flow effects, such as frictional losses, that take on greatly increased significance for the relatively small throat openings contemplated for the EGR valves hereof. These frictional losses can be related to large wetted perimeters (wall surface area relative to flow path area) of the flow area of the respective units. At low flows this relationship becomes very large as does the frictional loss which significantly reduces the energy recoverable by the diffuser to in turn significantly reduce the sonic operating range of the valve. However, comparatively speaking the FIG. 2 unit has a relatively smaller throat and its ratio of wetted perimeter to flow area is smaller than for comparable operation of the FIG. 1 unit. The former is thereby afforded a larger throat opening and less frictional loss under the identical flow conditions. Moreover, the reduced diffuser length available at lower flow conditions by the FIG. 2 configuration decreases the flow path and its frictional effect.

Figure 3:
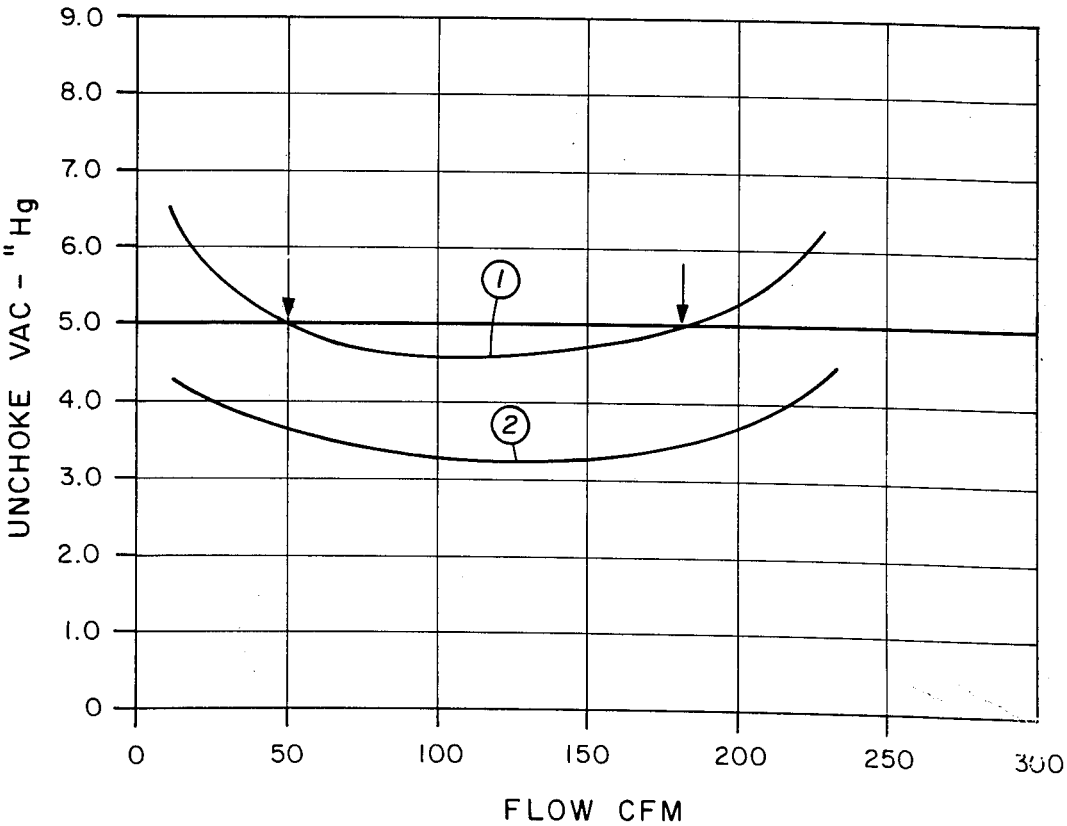
FIG. 3 is a graphical flow test comparison between the devices of FIGS. 1 and 2.

Further substantiating these mathematical conclusions are the air derived flow curves of FIG. 3 designated "1" and "2" for the units of FIGS. 1 and 2, respectively. The "unchoke" vacuum represents the minimum manifold vacuum (inches of mercury below standard atmosphere) at which sonic velocity through the throat can be maintained at the various flow levels. By arbitrarily selecting 5 inches of $H_g$ vacuum for purposes of comparison (EGR is not normally used at vacuums below that level), it can be seen that the FIG. 1 device will be maintained sonic between about 180 CFM to 50 CFM for a turn down ratio of less than 4, i.e. (180/50). By contrast, the FIG. 2 device remains sonic over the entire range tested of almost 250 CFM to less than 1 CFM for a turn down ratio of at least 250 to 1.

Not only, therefore, is greater turn down ratio available from the embodiment of FIG. 2 as compared with that of FIG. 1 but several other advantageous distinctions of the former over the latter can likewise be noted. It can be seen by again comparing those figures that when moving the pintle toward closure, diameter $a_2$ represents the smaller dimension of pintle 18 opposing the flow force $F_2$. This compares to $a_2$ being the larger dimension of pintle 10 aided, rather than opposed, by the flow force $F_1$. Since the operating force is differential pressure times the exposed pintle cross sectional area thereat, substantially greater forces must be kinematically overcome for axially displacing the larger area unit of FIG. 1 as compared to that of FIG. 2, or said otherwise, the operating force required for pintle 18 is significantly less than the equivalent force required for pintle 10. When $F_1$ in the former is added to by the high throat and diffuser vacuum urging the pintle toward the throat, the force necessary to move the pintle toward opening becomes significant, rendering opening of the flow passage increasingly difficult. By contrast, $F_2$ in the latter is reduced and the diffuser vacuum force which tends to force pintle 18 upward can just balance the pintle so that practically no force is required to open or close the throat. In a sense, this provides for automatic pintle adjustment relative to manifold vacuum, i.e. the higher the vacuum, the more closed the throat. Should failure occur in the mechanical control for displacing pintle 18, the valve can still function in a sonic controlled state, still providing exhaust gas recycle control over oxides of nitrogen production.

Moreover, a variable diffuser length is more readily possible for the FIG. 2 unit by utilizing an effective pintle length $l_p$ less than the diffuser length $l_n$. Such a feature offers a distinct advantage in control of area ratio for providing a wider turn down range. This perhaps can be best understood by considering that at low flow the diffuser should preferably be short to limit the flow path length with the large wetted perimeter. For the FIG. 1 unit, maximum capacity is limited by the diffuser exit area since the throat area approaches the exit area on opening. If, for example, an area ratio of two is needed at wide open, maximum throat area should be half as large as the exit area. By contrast, FIG. 2 unit capacity is limited by the throat diameter alone since diffuser exit area ia always at a greater diameter and greater area. Consequently, for an equivalent exit area flow path the throat diameter of the FIG. 2 unit is always significantly smaller than that of FIG. 1. The degree to which this applies is determined by the rate of opening desired with vertical movement and the shortness of diffuser desired.

Figure 4:
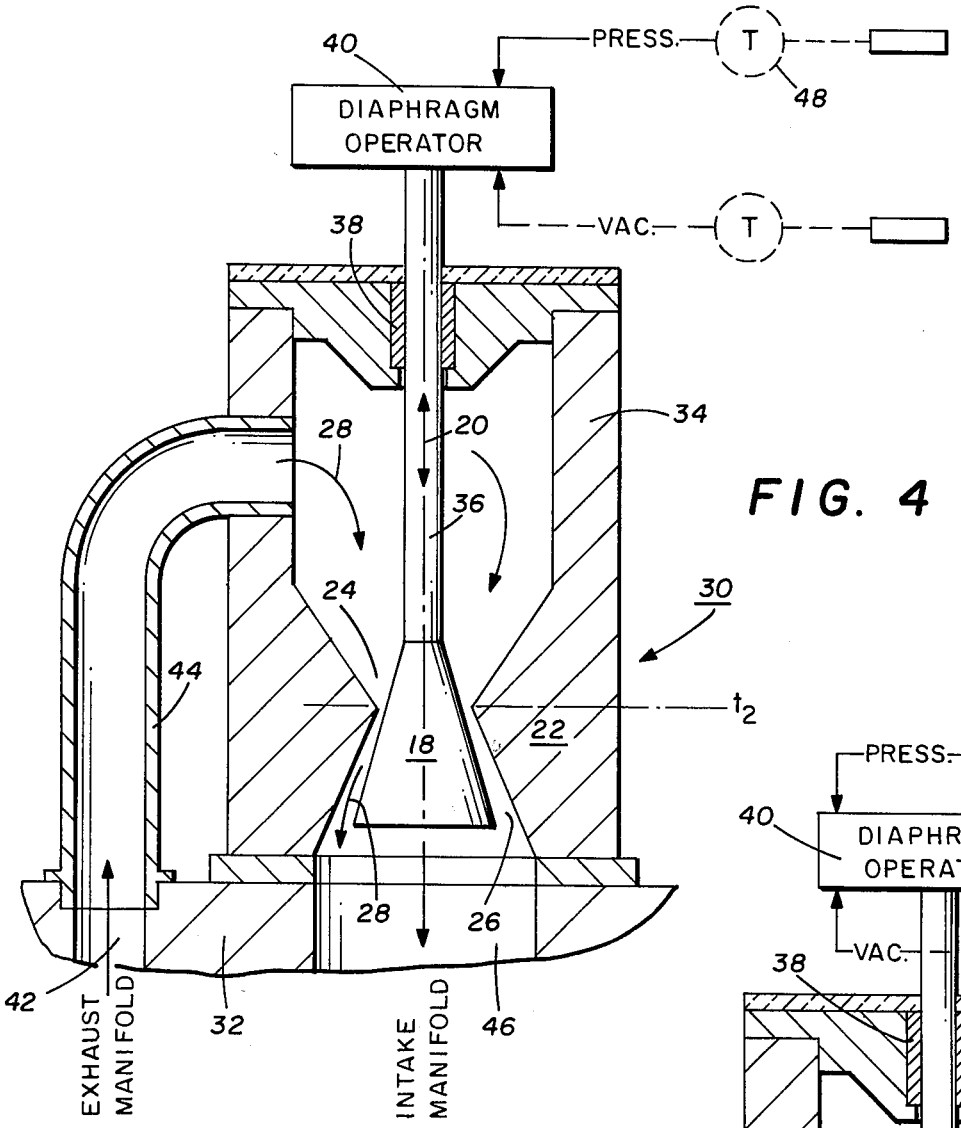
FIG. 4 is a schematic representation of a first embodiment exhaust gas recirculating valve in accordance herewith.

Referring now to FIG. 4, there is disclosed a first exhaust gas recirculation valve in accordance herewith designated 30 adapted for mounting on an engine block 32. The valve is formed of a generally enclosed housing 34 containing at its lower portion an annular convergent-divergent section composed of throat body 22. Centrally supported in the body is a pintle 18 as described above secured via a rod 36 for axial displacement with respect to throat plane $t_2$. Rod 36 in turn is slideably supported in sleeve 38 for displacement vertically in the direction of arrow 20 by diaphragm operator 40 in response to pressure or vacuum changes appropriately applied thereto.

Recirculating gas flow 28 through valve 30 is obtained from exhaust manifold 42 and by means of tubing 44 is transmitted to within housing 34. After entering intake 24, the flow passes through the throat at $t_2$ of size determined from the position setting of pintle 18 by operator 40. From that point the flow passes outward through diffuser 26 for discharge into intake manifold 46. Operator 40 can be actuated for positioning pintle 18 in response to predetermined conditions of engine operation such as acceleration, idling, etc. Suitable for positioning operator 40 is thermostat 48 sensing combustion chamber or exhaust temperature in the vicinity of the exhaust valve where because of the temperature relationship to the oxides of nitrogen can allow optimum operating economy of valve 30. Use of this temperature as a controlling factor for exhaust gas recycle flow provides a simple control element in place of the combination of a variety of measured engine parameters previously employed.

Figure 5:
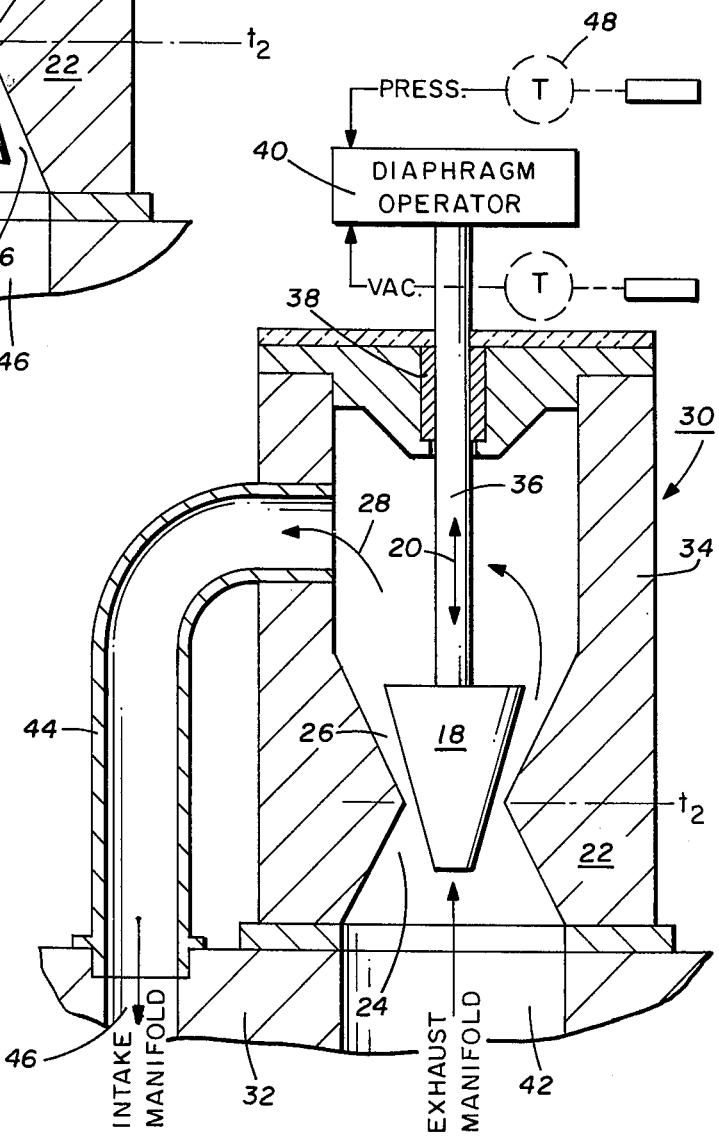
FIG. 5 is a schematic representation of a second embodiment exhaust gas recirculating valve in accordance herewith.

For the embodiment of FIG. 5, the direction of flow 28 from the exhaust to the intake manifold is reversed through the valve as compared to the previous embodiment. Of the two, the embodiment of FIG. 5 is to be preferred where exhaust temperatures are a problem because of the relatively reduced exhaust heat exposed in proximity to valve operator 40.

By the above description there has been disclosed an exhaust gas recirculation valve for automotive applications affording sonic flow over the entire contemplated turn down range in response to predetermined engine variables. Being constructed in the manner hereof the EGR valve is able to afford the degree of control for which such valves were perceived but for which the sought after result has previously been unattainable. Yet, this is attained herein by a relatively simple construction utilizing an axially displaceable pintle in a throat body forming an annular converging-diverging nozzle, with the pintle arranged when closing the valve to move in a direction counter to the direction of incoming flow. This compares in contrast with the prior art construction in which the pintle is operably reversed therefrom and as a result of which attaining the sought after sonic turn down range has been precluded.

Since many changes could be made in the above construction and many apparently widely different embodiments of this invention could be made without departing from the scope thereof, it is intended that all matter contained in the drawings and specification shall be interpreted as illustrative and not in a limiting sense.

The embodiments of the invention in which an exclusive property or privilege is claimed are defined as follows:

1. In an exhaust gas recirculating valve adapted for use with an internal combustion engine comprising a housing internally containing a convergent-divergent flow path between a first opening adapted to receive exhaust gas from the exhaust manifold and a second opening adapted to discharge gas received from said first opening to the intake manifold, a movable pintle cooperating in said flow path to define a nozzle therewith for effecting sonic gas flow through the nozzle throat and operator means effective to axially displace said pintle toward and away from the nozzle throat in response to a predetermined engine variable, the improvement in which the direction of pintle movement by said operator toward restricting the flow area through said nozzle throat is counter to the direction of incoming flow adapted to be received at said first opening.

2. In an exhaust gas recirculating valve according to claim 1 in which said first opening is adapted for mounting on an engine with which it is to be used in relatively closer proximity to the engine block than said second opening.

3. In an exhaust gas recirculating valve according to claim 2 in which said second opening is located spaced downstream from the exit plane of the nozzle diffuser and there is included conduit means for connecting the discharge from said second opening to the intake manifold of the engine.

4. In an exhaust gas recirculating valve according to claim 2 in which the axial length of said pintle extending downstream from the nozzle throat is less at maximum flow setting of said throat than the length of the divergent portion of the housing thereat.

5. In an exhaust gas recirculating valve according to claim 2 including temperature sensitive means for exposure to a source of engine operating temperature and said operator is actuated by said temperature sensitive means for displacing said pintle in correlation to the temperature changes to which the temperature sensitive means is exposed.

6. In an exhaust gas recirculating valve according to claim 1 in which said second opening is adapted for mounting on an engine with which it is to be used in relatively closer proximity to the engine block than said first opening.

7. In an exhaust gas recirculating valve according to claim 6 in which said first opening is located spaced upstream from the intake of the nozzle and there is included conduit means for connecting said first opening to the exhaust manifold of the engine.

8. In an exhaust gas recirculating valve according to claim 6 in which the axial length of said pintle extending downstream from the nozzle throat is less at maximum flow setting of said throat than the length of the divergent portion of the housing thereat.

9. In an exhaust gas recirculating valve according to claim 6 including temperature sensitive means for exposure to a source of engine operating temperature and said operator is actuated by said temperature sensitive means for displacing said pintle in correlation to the temperature changes to which the temperature sensitive means is exposed.

10. In a method of operating an exhaust gas recirculating valve to maintain sonic conditions for gas flow passing through the valve from the exhaust manifold to the intake manifold of an internal combustion engine and including a pintle axially displaceable in cooperation with a throat body to form a converging-diverging nozzle in the flow path through the valve, the improvement comprising operating said pintle toward restricting the flow area through the throat of said nozzle in a direction opposed to the direction of gas flow being received from the exhaust manifold to effectively maintain said sonic conditions through a wide range of turn down ratios.

11. In a method of operating an exhaust gas recirculating valve according to claim 10 in which said pintle displacement is effected in correlation to engine temperature.

* * * * *